US006668406B2

(12) United States Patent
Spinks et al.

(10) Patent No.: US 6,668,406 B2
(45) Date of Patent: Dec. 30, 2003

(54) SPRING UNITS

(75) Inventors: Peter Douglas Spinks, North Yorkshire (GB); Simon Paul Spinks, North Yorkshire (GB)

(73) Assignee: A Harrison (Bedding) Limited, Leeds (GB)

( * ) Notice: Subject to any disclaimer, the term of this patent is extended or adjusted under 35 U.S.C. 154(b) by 201 days.

(21) Appl. No.: 09/319,680

(22) PCT Filed: Jul. 1, 1997

(86) PCT No.: PCT/GB97/01759

§ 371 (c)(1),
(2), (4) Date: Jun. 9, 1999

(87) PCT Pub. No.: WO98/25503

PCT Pub. Date: Jun. 18, 1998

(65) Prior Publication Data

US 2002/0152554 A1 Oct. 24, 2002

(30) Foreign Application Priority Data

Dec. 10, 1996 (GB) ..... 9625616

(51) Int. Cl.[7] ..... A47C 23/04; A47C 27/06
(52) U.S. Cl. ..... 5/655.8; 5/720; 5/256
(58) Field of Search ..... 5/716, 720, 727, 5/729, 654.1, 655.7, 655.8, 246, 248, 256, 268; 267/92, 168

(56) References Cited

U.S. PATENT DOCUMENTS

| | | | | | |
|---|---|---|---|---|---|
| 837,751 | A | * | 12/1906 | Summers | 5/246 |
| 912,855 | A | * | 2/1909 | King | 5/256 X |
| 1,192,510 | A | | 7/1916 | Fischmann | 5/655.8 |
| 2,631,840 | A | | 3/1953 | Bugenhagen | 5/256 X |
| 2,724,842 | A | * | 11/1955 | Rogovy | 5/248 |
| 3,031,690 | A | | 5/1962 | Ramsay | 267/94 X |
| 3,298,337 | A | * | 1/1967 | Thompson | 267/168 X |
| 3,507,486 | A | * | 4/1970 | Schwaller | 267/168 X |
| 2002/0152554 | A1 | * | 10/2002 | Spinks et al. | 5/655.8 |

FOREIGN PATENT DOCUMENTS

| | | | | |
|---|---|---|---|---|
| DE | 3038634 | * | 5/1981 | 267/168 |
| DE | 3203409 | * | 11/1982 | 267/168 |
| DE | 4016607 | | 3/1991 | |
| DE | 4200553 | | 7/1993 | |
| FR | 1120494 | * | 4/1956 | 267/168 |
| RU | 696206 | * | 11/1979 | 267/168 |
| RU | 1219847 | * | 3/1986 | 267/168 |

* cited by examiner

*Primary Examiner*—Robert G. Santos
(74) *Attorney, Agent, or Firm*—Klauber & Jackson

(57) ABSTRACT

A spring unit (2) for incorporation into a bed, divan bed, mattress, or other upholstery unit comprises a first spring (4) and a second spring located (6) within said first spring (4). The first spring (4) may be a pocketted spring, or the second spring may be a pocketted spring, or both of said springs may be pocketted springs, the pockets of said pocketted springs being composed of a woven material and/or a synthetic material.

12 Claims, 2 Drawing Sheets

SPRING UNITS

BACKGROUND OF THE INVENTION

1. Field of Invention

This invention relates to spring units and more particularly to spring units for beds, divan beds, mattresses, and other upholstery units. Such beds etc will be hereinafter referred to as 'sprung units'.

2. Description of the Related Art

Sprung units are conventionally made in differing degrees of hardness, this usually being achieved by varying the number of springs per unit area—generally known as 'the spring count'—of the sprung unit, or by changing the gauge of the wire from which the springs are made. Such variation in the manufacturing procedure, i.e. the incorporation of differing numbers of springs or changing the wire gauge, complicates the manufacturing procedure and consequently increases the manufacturing costs.

It has previously been proposed to incorporate a second spring within a first spring so as to form a double spring unit whereby the springs are compressed in stages so as to lessen the shock on the sprung unit when a person sits or lays upon the sprung unit, Examples of such spring units are shown and described in U.S. Pat. Nos. 1,192,510 (Fischmann), 3,031,690 (Ramsey), and 2,631,840 (Bugenhagen). However, in such previous proposals, the second spring has been connected, either directly or indirectly, to said first spring such that the second spring has not been freely movable within said first spring, which places restrictions on the sprung unit in use.

SUMMARY OF THE INVENTION

The present invention therefore seeks to provide an improved form of spring unit which will obviate the disadvantages of known spring units.

According to the present invention there is provided a spring unit for incorporation into a bed, divan bed, mattress, or other upholstery unit comprising a first spring and a second spring located within said first spring, said second spring having no connection to said first spring so as to be freely movable within said first spring.

Preferably, the length of said second spring will be less than that of said first spring.

In an embodiment of the invention, the first spring may be a pocketted spring, and in an alternative embodiment of the invention the second spring may be a pocketted spring. In yet a further alternative embodiment, each of said first and second springs may be pocketted springs.

The pocket of the or each pocketted spring may be composed of a woven material such as calico which is sewn in order to form the pocket(s). Alternatively, the pocket(s) may be composed of synthetic material which is sewn or sonic or heat welded in order to form the pocket(s). Where both springs are pocketted springs, both pockets may be composed of a woven material or both may be composed of synthetic material, or the pockets may be formed one of each material, the pocket of woven material preferably being around said first spring.

According to another aspect of the present invention there is provided a sprung unit incorporating a plurality of spring units, each of said spring units comprising a first spring and a second spring located within said first spring.

BRIEF DESCRIPTION OF THE DRAWINGS

In order that the invention may be more readily understood, embodiments of the invention will now be described, by way of example only, reference being made to the accompanying drawings, wherein.

DESCRIPTION OF THE PREFERRED EMBODIMENTS

Figure 1:
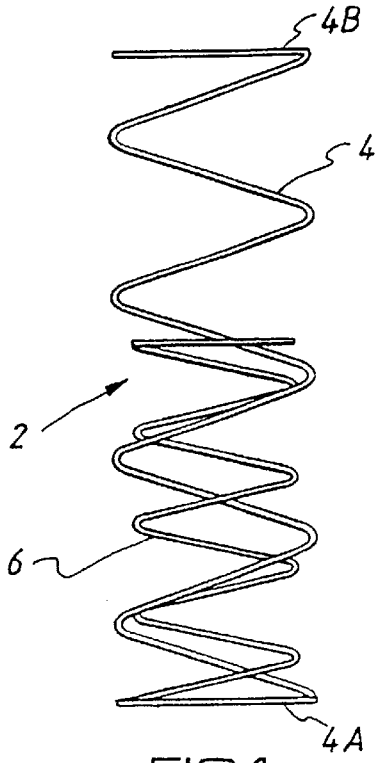
FIG. 1 is a view of a spring unit according to a first embodiment of the invention.

Referring to the drawings and firstly to FIG. 1, there is shown a spring unit which is indicated generally by reference numeral 2 and which comprises a first, outer spring 4 and a second unconnected, inner spring 6. As will be seen, the length of the inner spring is less than the length of the outer spring 4, and the pitch of the spring 6 is less than that of the spring 4.

The inner spring 6, captive within the outer spring 4, is movable longitudinally within the outer spring 4 between the end 4A and the other end 4B of the spring 4.

Figure 2:
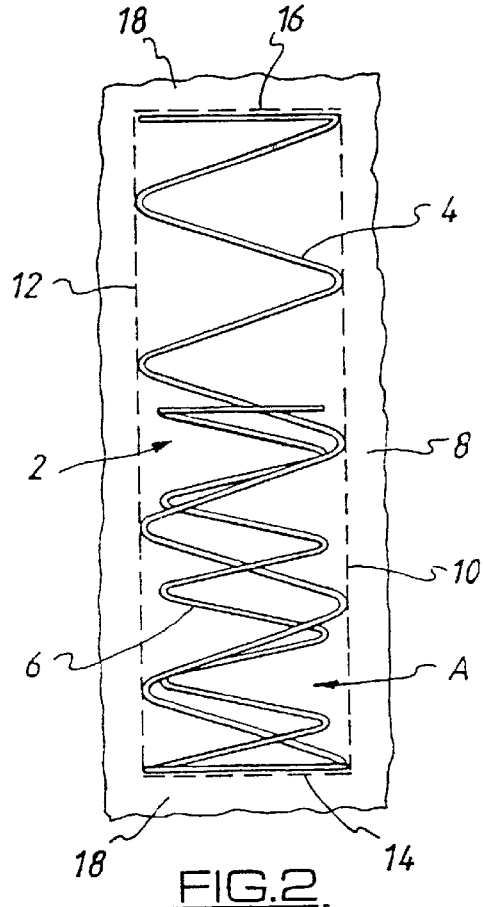
FIG. 2 is a view of a spring unit according to a second embodiment of the invention.

Referring now to FIG. 2, it will be seen that the outer spring 4 and the inner spring 6 are located within a single pocket 8—so as to form a pocketted spring A—in engagement with the outer spring 4. The pocket is formed by longitudinal lines of retention 10 and 12 and by lateral lines of retention 14 and 16.

The pocket 8 may be composed of a woven material such as calico, in which case the lines of retention will be formed by sewing. Alternatively, the pocket 8 may be composed of a synthetic material, in which case the lines of retention may be formed either by sewing or by means of sonic or heat welding.

As with the spring unit of FIG. 1, the inner spring 6 is movable within the pocket 8 of the outer spring 4, as shown in FIG. 2.

Figure 3:
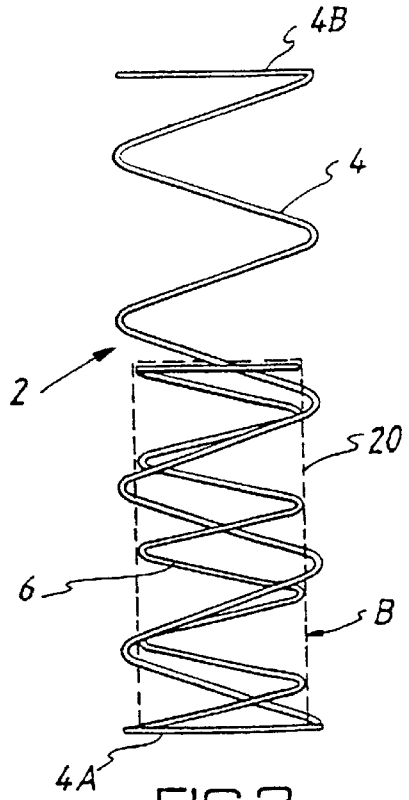
FIG. 3 is a view of a spring unit according to a third embodiment of the invention.

FIG. 3 illustrates a spring unit 2 in which the inner spring 6 is located within a pocket 20—so as to form a pocketted spring B—which is composed of either a woven material such as calico, in which case the pocket will be secured in position around the spring 6 by sewing, or alternatively of synthetic material, in which case the pocket 20 will be secured in position around the spring 6 either by sewing or by sonic or heat welding. The pocketted spring B, formed by the pocket 20 and the spring 6, is as in the embodiment of FIGS. 1 and 2, movable longitudinally between the end 4A and the end 4B of the outer spring 4.

Figure 4:
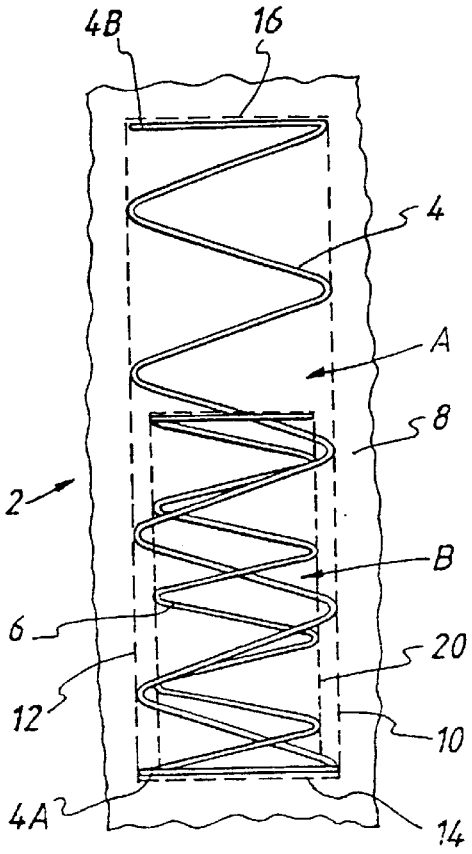
FIG. 4 is a view of a further embodiment of a spring unit according to the invention.

Referring now to FIG. 4, there is illustrated a 'composite' pocketted spring unit which is a combination of the spring units of FIGS. 2 and 3. Thus the spring unit of FIG. 4 comprises an outer pocketted spring A and an inner pocketted spring B, and for ease of identification, the reference numerals of FIGS. 2 and 3 have been applied to FIG. 4. The inner pocketted spring B is movable longitudinally within the outer pocketted spring A from one end 4A to the other end 4B of the outer pocketted spring A.

The pockets of the pocketted springs A and B may both be composed of a woven material such as calico, or both may may be composed of a synthetic material, or there may be one of each, in which case it is preferred that the pocket of pocketted spring A is composed of the woven material.

Figure 5:
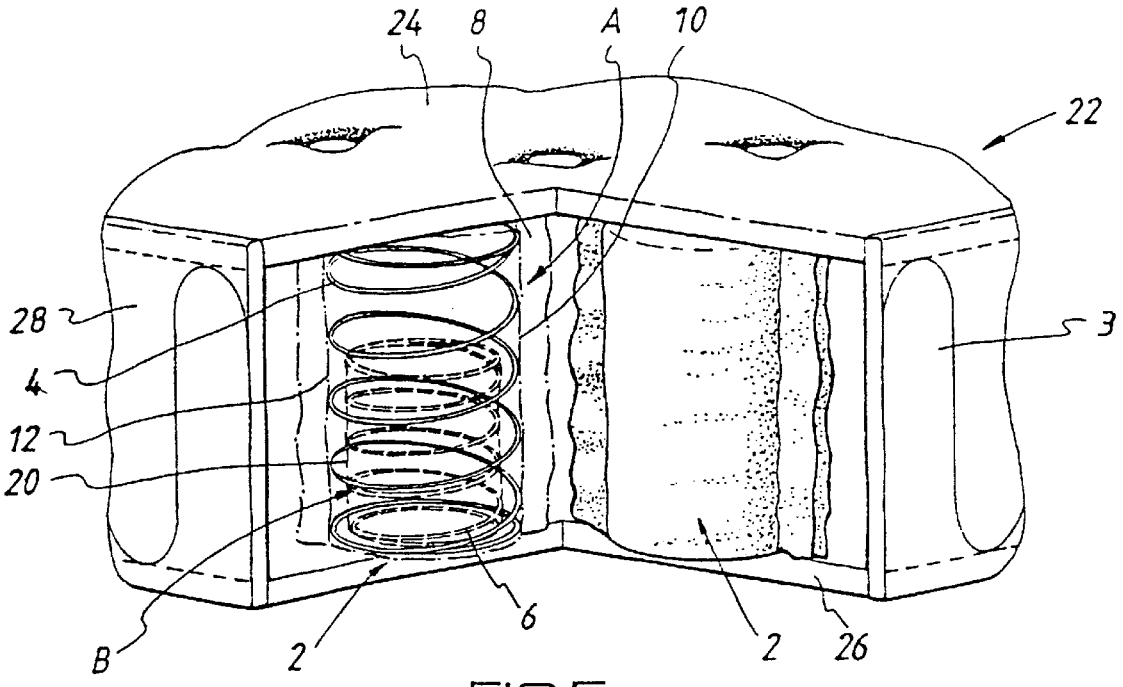
FIG. 5 is a view of a sprung unit, partly cut away, to show the incorporation of a plurality of spring units.

In use, and referring to now to FIG. 5, which illustrates part of sprung unit 22, it will be seen that the unit incorporates a plurality—two are indicated—of the spring units as shown in FIG. 4, i.e. the composite pocketted spring unit. The spring units 2 are located between upper and lower layers of padding 24 and 26 and side walls 28 and 30, the spring units being held in position in conventional manner.

The sprung unit 22 may be formed wholly of spring units in accordance with the invention, or alternatively a plurality of spring units in accordance with the invention may be used in conjunction with or in combination with a plurality of conventional pocketted springs, or indeed with other suitable types of conventional and known springs.

Thus the invention provides a spring unit 2 and a sprung unit 22 which incorporates a plurality of said spring units 2 wherein, in use of the sprung unit 22, the outer spring 4 will be partially compressed first followed by compression together of the outer spring 4 and the inner spring 6, the amount of compression of the spring(s) being dependent upon the weight of the user.

Thus there is provided a sprung unit, i.e. a bed, divan bed, mattress or other upholstery unit, whose degree of hardness is variable—depending upon the amount of compression of the springs of the sprung unit—and therefore it will not be necessary to manufacture 'hard' sprung units and 'soft' sprung units by varying the 'spring count' of the unit, such 'spring count' automatically being adjusted and established by the user of the sprung unit.

Finally, it will be appreciated that whilst parallel springs and spring units have been described and illustrated, the invention is equally applicable to barrel shaped and other shaped springs and spring units.

What is claimed is:

1. A spring unit (2) for incorporation into a mattress, said mattress having a first surface and a second surface, and said spring unit comprising a first spring (4) having a first end and a second end, and a second spring (6) having a first end and a second end, said second spring being located within said first spring (4) and having no connection to said first spring (4) so as to be freely movable within said first spring (4) from the first end of said first spring to the second end, wherein in a first position of the mattress the first end of the second spring (6) is adjacent the first end of the first spring (4) and the first surface of the mattress, and in a second, reversed position of the mattress, the first end of the second spring is adjacent the second end of the first spring (4) and the second surface of the mattress.

2. A spring unit according to claim 1, wherein the length of said second spring (6) is less than that of said first spring (4).

3. A spring unit according to claim 1 or claim 2, wherein said first spring (4) is a pocketted spring (A).

4. A spring unit according to claim 1 or claim 2, wherein said second spring (6) is a pocketed spring (B).

5. A spring unit according to claim 3, wherein said first pocketted spring (A) comprises springs (4,6) located within a pocket 8 of woven material or synthetic material.

6. A spring unit according to claim 5, wherein said pockets (8,20) of woven material or synthetic material are formed by sewing, heat welding or sonic welding.

7. A bed, divan bed, mattress, or other upholstery unit incorporating a plurality of spring units according to claim 1.

8. A spring unit according to claim 3, wherein said second spring (6) is a pocketed spring (B).

9. A spring unit according to claim 4, wherein said first pocketted spring (A) comprises a spring (4) located within a pocket (8) of woven material or synthetic material and in that said second pocketted spring (B) comprises a spring (6) located within a pocket (20) of woven material or synthetic material.

10. A spring unit according to claim 9, wherein said pockets (8,20) of woven material are formed by sewing, heat welding or sonic welding.

11. The bed, divan, mattress or other upholstery unit according to claim 7 further comprising reversible sides, wherein said plurality of spring units are arranged so that said bed, divan, mattress or other upholstery unit provides a same degree of variable hardness irrespective of which particular side is in contact with a user.

12. A bed, divan, mattress or other upholstery unit incorporating a plurality of spring units each comprising a first pocketted spring (A) having two ends and a second pocketted spring (B) located within said first pocketted spring (A), wherein said second pocketted spring (B) has no connection to said first pocketted spring (A) so as to be freely movable within said first pocketted spring from one end of said first spring to the other end.

* * * * *